United States Patent [19]

Kogure et al.

[11] Patent Number: 4,469,322

[45] Date of Patent: Sep. 4, 1984

[54] PAPER GUIDE DEVICE OF ELECTROPHOTOGRAPHY COPYING MACHINE

[75] Inventors: Yoshio Kogure; Satoru Komiya, both of Kanagawa, Japan

[73] Assignee: Fuji Xerox Co., Ltd., Tokyo, Japan

[21] Appl. No.: 390,599

[22] Filed: Jun. 21, 1982

[30] Foreign Application Priority Data

Oct. 15, 1981 [JP] Japan ..... 56-163412

[51] Int. Cl.[3] ..... B65H 5/38

[52] U.S. Cl. ..... 271/264; 355/3 SH

[58] Field of Search ..... 271/264, 245, 246, 242, 271/272–274, 229, 275, DIG. 2; 355/3 SH, 3 TR

[56] References Cited

U.S. PATENT DOCUMENTS

| | | | |
|---|---|---|---|
| 4,025,187 | 5/1977 | Taylor et al. | 271/245 |
| 4,183,653 | 1/1980 | Satomi et al. | 271/DIG. 2 |
| 4,260,238 | 4/1981 | Kozuka et al. | 355/3 TR |
| 4,285,507 | 8/1981 | Marinoff | 271/246 |

*Primary Examiner*—Bruce H. Stoner, Jr.
*Assistant Examiner*—James E. Barlow
*Attorney, Agent, or Firm*—Sughrue, Mion, Zinn, Macpeak, and Seas

[57] ABSTRACT

A paper guide member adjacent a receptor along a paper transport path is provided with a bifurcation slot having a width greater than the typical width of a stiff paper but narrower than the width of most thinner papers to permit the stiff papers to deform out of the paper transport path upon contacting the receptor.

3 Claims, 4 Drawing Figures

PAPER GUIDE DEVICE OF ELECTROPHOTOGRAPHY COPYING MACHINE

BACKGROUND OF THE INVENTION

The present relates to a paper guide device for an electrophotographic copying machine capable of smoothly transporting thick paper such as a post card.

In a typical electrophotographic copying machine, the process of transporting paper to a fixing device comprises the steps of guiding the paper sheet fed from the paper feeder to a transfer device in the vicinity of the photoreceptor, attaching the paper sheet onto a photoreceptor surface, and then transferring a toner image of the photoreceptor surface onto the paper sheet. Paper guide members for smoothly guiding the paper sheet are disposed in the paper transporting path. In case of transporting general paper which is thin and flimsy, resistance between the paper and the guide members is low, which provides smooth paper transportation. On the other hand, in case of transporting thick paper such as a post card, the resistance is high, i.e. the transporting force is low, which causes slow-speed transportation, inability to transport paper on the paper-transporting path or paper-jam. Conventionally, therefore, forced paper transportation by gripper, roller or stripping belt has been adopted, which also causes image deletion at the portion where the paper sheet contacts these transportation components.

SUMMARY OF THE INVENTION

An object of the present invention is to overcome these disadvantages, that is, to provide for an electrophotographic copying machine which is capable of smoothly transporting paper without causing image deletion on either thick paper such as a post card or on general copy paper.

Briefly, this is achieved according to the present invention by providing a relief in the paper transport path immediately adjacent the receptor so that a relatively rigid paper upon contacting the receptor will be permitted to deform without engaging and jamming in the walls of the paper transport path. In a preferred embodiment, the relief is provided by bifurcating the guide member on the side of the transport path opposite the direction in which the paper will be urged by the receptor. The bifurcation slot is designed to have a width such that the stiffer papers which tend to be smaller, such as post cards or the like, will fit between the bifurcation slot, while the larger thin papers will be retained by the bifurcated portions of the guide member.

In an alternative embodiment, an elastic member is provided in the bifurcation slot to still permit deformation of the stiffer papers while preventing the leading edge of a narrow thin paper from deforming upwardly into the bifurcation slot.

BRIEF DESCRIPTION OF THE DRAWINGS

The invention will be more clearly understood from the following description in conjunction with the accompanying drawings, in which.

DETAILED DESCRIPTION OF THE PREFERRED EMBODIMENTS

Figure 1:
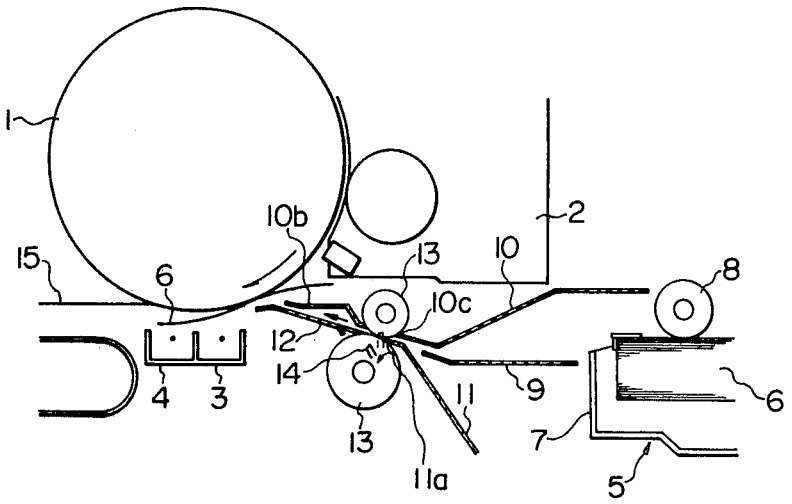
FIG. 1 is a schematic side view of one embodiment of the invention.
Figure 2:
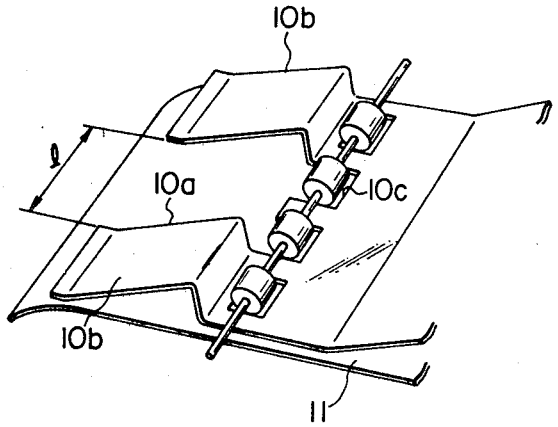
FIG. 2 is a perspective view of the bifurcated guide member configuration of FIG. 1.

Referring to the figures, one embodiment of the present invention will now be described. In the figures, 1 is a photoreceptor, 2 is a developing device disposed in the vicinity of the photoreceptor, 3 is a transfer corotron and 4 is a detack corotron. 5 is a paper feeder which feeds paper 6 toward the transfer corotron 3, the paper feeder comprising a cassette tray 7 where paper 6 is provided and a feed roller 8 for feeding each paper sheet from the cassette tray 7. The paper sheet 6 fed from the feed roller 8 is inserted by a guide plate 9 between upper and lower paper guide members 10, 11. The lower paper guide member 11 comprises an inverted v-shaped plate with the end at the side of the paper feeder 5 inclining below the plate 9 and the other end located in the vicinity of the photoreceptor 1. With this structure, the leading edge of the paper sheet 6 inserted by the guide plate 9 is transported by the guide members 10 and 11 to a position where the paper sheet contacts the photoreceptor surface. Additionally the upper paper guide member 10 comprises a v-shaped plate, the end at the side of the paper feeder 5 itself comprising an inverted v-shaped plate and located in the vicinity of the feed roller 8. The other end, as illustrated in FIG. 2, is bifurcated by a cut **10*a* made from a middle bending position to the end. The width of the cut 10*a* is a little wider than that of a thick paper 6 such as a post card. Further, the cut pieces 10*b* of the upper guide member 10 are and inverted v-shaped and each has a leading edge located in the vicinity of the photoreceptor 1, so that the leading edge of the general paper sheet 6 between the cut pieces 10*b* and the lower paper guide member 11** is transported to the position where it contacts the photoreceptor surface.

Meanwhile, a plurality of juxtaposed square apertures **10*c*, 11*a* are provided in the width direction of the paper guide members 10, 11 at a position of the upper and lower paper guide members nearer to the photoreceptor 1 than to the middle bending position. A pair of register rollers and a register nail project from these square apertures 10*c*, 11*a* into the paper transporting path 12 between the upper and lower guide members 10, 11. The register rollers 13 pressure-contact each other in the paper transporting path 12 and nip the leading edge of the paper sheet 6 transported by the upper and lower paper guide members 10, 11. Also the register nail 14, which is capable of appearance and disappearance in the paper transporting path 12, sets feed timing by temporarily stopping the paper transportation upon its appearance in the paper transporting path 12 and enabling the register roller 13 to transport the paper sheet 6 upon its disappearance. 15 shows a stripping finger for stripping the paper sheet 6** from the photoreceptor.

With the foregoing structure, the process of transporting general thin paper comprises the steps of inserting the paper sheet 6 from the paper feeder 5 between paper guide members 10, 11 feeding it to the photoreceptor 1 through the paper transporting path 12, contacting the paper with the photoreceptor surface 1, transferring the toner image onto the paper, stripping the leading edge of the paper onto which the image is transferred from the photoreceptor 1 by a stripping finger 15, transporting it to a fixing device (not illustrated), guiding the trailing edge of the paper 6 until the end by the upper and lower paper guide members 10, 11, and then transporting the trailing edge to the photoreceptor 1. Thus, the general paper 6, although its transported path is bent by the upper and lower paper guide members, is smoothly transported, without increased resistance, due to its flimsy characteristics.

Meanwhile, the process of transporting thick paper such as a post card comprises the steps of inserting a leading edge of the paper 6 from the paper feeder 5 between the upper and lower paper guide members, and feeding to to the photoreceptor 1 where the leading edge of the paper 6 is bent along the photoreceptor surface. As the card contacts the photoreceptor surface and is bent downwardly, it will tend to resist bending due to its stiff construction and it will therefore pivot about the front edge of the guide member 11 such that the trailing edge of the card will be urged upwardly. With the trailing edge still secured by the rollers 13, the middle portion of the card will tend to curve upwardly. This curvature, however, will not result in a substantial increase in the transport resistance since the cut 10*a* is wider than the card and therefore permits the card to curve freely. The transport process further comprises separating the trailing edge of the paper 6 from the register rollers 13, whereby the trailing edge of the paper springs upward and also the resistance decreases, and then transporting the paper 6 through the transfer process. Thus, the cut 10*a* for receiving the upward curve of the paper allows paper transportation with a small transporting force without changing the transporting speed.

In the above embodiment a post card is provided as an example of thick paper, but other thick paper may also be used. The width of the cut 10*a* of the upper guide member 10 may be changed according to paper size.

Figure 3:
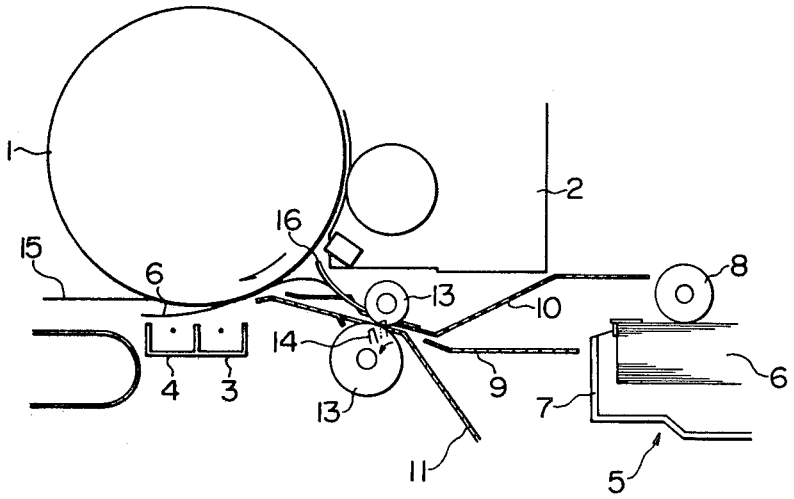
FIG. 3 is a schematic side view of a second embodiment of the invention.
Figure 4:
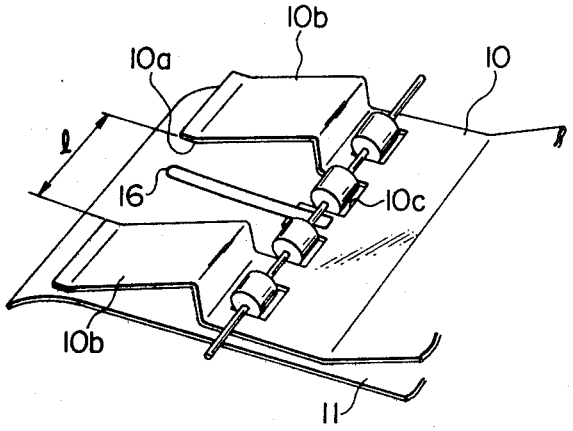
FIG. 4 is a perspective view of the bifurcated guide member of FIG. 3.

FIG. 3 and FIG. 4 illustrate another embodiment wherein a tongue-shaped elastic guide member 16 made of elastic material such as Mylar tape is disposed at the center of the cut 10*a*. One end of the elastic guide member 16 is fixed at the upper guide member 10. This elastic guide member represses an upward jump of the backward edge of the paper 6 after passing the register rollers 13 and prevents incomplete toner transfer on the paper 6. Also, it represses an upward curve of the leading edge of small-sized thin paper which would otherwise be permitted by the cut 10*a* and prevents a position-discrepancy between the toner image on the photoreceptor surface and the paper 6. For receiving the upward curve of the paper 6, a relief formed by curving a part of the upper guide member 10 upward also achieves the same effect as the cut 10*a*.

As described above, the present invention can transport even thick paper such as a post card without increasing the resistance by providing a relief in the upper guide member for an upward curve of the paper. Therefore, an image deletion caused by paper grip-type forced transportation does not occur and a stable paper transportation even by a small transporting force is obtained without paper-jam.

We claim:

1. In a paper guide device for an electrophotographic copying machine of the type wherein a first paper having a first width and a second paper having a second width may be transported to a receptor along a paper transport path defined between first and second guide members, each of said first and second guide members having a downstream end adjacent said receptor, the improvement characterized in that one of said guide members includes at its downstream end first and second portions and an open-ended bifurcation slot therebetween, said bifurcation slot being larger than said width of said second paper and smaller than said width of said first paper, whereby, when said first paper contacts said receptor and is urged against said one of said guide members said first and second portions retain said first paper within said paper transport path defined between said first and second guide members, and when said second paper contacts said receptor and at least a portion of said second paper is urged in the direction of said one of said guide members, said portion of said second paper is permitted to extend through said bifurcation slot outside of said path defined between said first and second guide members.

2. A paper guide device as claimed in claim 1, wherein said receptor urges said first or second papers in a first direction when a leading edge of either of said papers contacts said receptor, and said one of said first and second guide members is on a side of said paper transport path opposite said first direction.

3. A paper guide device as claimed in claim 1, wherein the improvement further comprises an elastic member extending into said bifurcation slot for urging said second paper toward the other of said guide members.

* * * * *